US010883692B2

(12) United States Patent
Kitazawa

(10) Patent No.: US 10,883,692 B2
(45) Date of Patent: Jan. 5, 2021

(54) LAMP UNIT AND VEHICULAR HEADLAMP

(71) Applicant: KOITO MANUFACTURING CO., LTD., Tokyo (JP)

(72) Inventor: Tatsuma Kitazawa, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 16/750,455

(22) Filed: Jan. 23, 2020

(65) Prior Publication Data

US 2020/0158308 A1 May 21, 2020

Related U.S. Application Data

(63) Continuation of application No. PCT/JP2018/026985, filed on Jul. 18, 2018.

(30) Foreign Application Priority Data

Jul. 26, 2017 (JP) ..... 2017-144667

(51) Int. Cl.
*F21S 41/675* (2018.01)
*F21S 41/13* (2018.01)
(Continued)

(52) U.S. Cl.
CPC ..... *F21S 41/675* (2018.01); *F21S 41/13* (2018.01); *F21S 41/141* (2018.01); *F21S 41/62* (2018.01)

(58) Field of Classification Search
CPC ..... F21S 41/675; F21S 41/13; F21S 41/141; F21S 41/62
(Continued)

(56) References Cited

U.S. PATENT DOCUMENTS 5,023,758 A * 6/1991 Allen ..... F21S 41/645 362/514
2008/0037269 A1* 2/2008 Sugiyama ..... F21V 9/40 362/510
(Continued)

FOREIGN PATENT DOCUMENTS

JP 2012-224317 A 11/2012
JP 2014-078476 A 5/2014
(Continued)

OTHER PUBLICATIONS

International Preliminary Report on Patentability (Form PCT/IB/373) and the Written Opinion of the International Searching Authority (Form PCT/ISA/237) dated Jan. 28, 2020, in corresponding International Application No. PCT/JP2018/026985. (14 pages).
(Continued)

*Primary Examiner* — Bryon T Gyllstrom
(74) *Attorney, Agent, or Firm* — Buchanan Ingersoll & Rooney PC

(57) ABSTRACT

A lamp unit includes a light source including a first light emitting element that emits visible light and a second light emitting element that emits infrared light, and a rotating reflector that rotates about a rotational axis while reflecting visible light and infrared light emitted from the light source. The light source is configured such that part of the second light distribution pattern overlaps with the first light distribution pattern and such that a region of the second light distribution pattern, which does not overlap with the first light distribution pattern, is provided on the side closer to a middle region in front of the vehicle with respect to the first light distribution pattern.

5 Claims, 7 Drawing Sheets

(51) Int. Cl.
*F21S 41/141* (2018.01)
*F21S 41/62* (2018.01)

(58) Field of Classification Search
USPC ..... 362/514
See application file for complete search history.

(56) References Cited

U.S. PATENT DOCUMENTS

2008/0037270 A1* 2/2008 Kagiyama ..... F21V 9/40 362/510
2013/0038736 A1* 2/2013 Yamamura ..... F21S 41/36 348/148
2014/0042325 A1 2/2014 Yamamura
2015/0137680 A1* 5/2015 Komatsu ..... F21S 41/16 315/82
2015/0375672 A1* 12/2015 Takahashi ..... F21S 41/675 701/49
2016/0152175 A1* 6/2016 Hwang ..... G02B 19/0014 362/514
2017/0159904 A1 6/2017 Yamamura
2018/0180247 A1* 6/2018 Park ..... F21S 41/675
2019/0384054 A1* 12/2019 Mukojima ..... F21S 41/147
2020/0158307 A1* 5/2020 Kanamori ..... F21V 7/09

FOREIGN PATENT DOCUMENTS

JP 2016-021419 A 2/2016
WO 2015/045946 A1 4/2015

OTHER PUBLICATIONS

International Search Report (Form PCT/ISA/210) dated Sep. 11, 2018, in corresponding International Application No. PCT/JP2018/026985. (3 pages).

* cited by examiner

32

LAMP UNIT AND VEHICULAR HEADLAMP

CROSS-REFERENCE TO RELATED APPLICATIONS

This application is based upon and claims the benefit of priority from the prior Japanese Patent Application No. 2017-144667, filed on Jul. 26, 2017 and International Patent Application No. PCT/JP2018/026985, filed on Jul. 18, 2018, the entire content of each of which is incorporated herein by reference.

BACKGROUND OF THE INVENTION

1. Field of the Invention

The present invention relates to a lamp unit and a vehicular headlamp.

2. Description of the Related Art

There have been conventionally devised various methods for detecting the preceding vehicle, pedestrians, and obstacles present in front of a vehicle. For example, Patent Literature 1 discloses an obstacle detecting device that includes: a light source including two LED units for emitting visible light, and an infrared light unit, provided between the two LED units, for emitting infrared light; and a rotating reflector that rotates about a rotational axis in one direction while reflecting visible light and infrared light emitted from the light source.

[Patent Literature 1] Japanese Unexamined Patent Application Publication No. 2012-224317

The obstacle detecting device described above also functions as an optical unit in a headlamp; however, light distribution patterns produced respectively by the right headlamp and the left headlamp are substantially identical. Therefore, there is room for improvement in production of various light distribution patterns using visible light and infrared light.

SUMMARY OF THE INVENTION

The present invention has been made in view of such a situation, and a purpose thereof is to provide a new optical unit capable of producing various light distribution patterns using infrared light and visible light.

To solve the problem above, a lamp unit of one embodiment of the present invention is mounted on the right side or left side of a vehicle, and the lamp unit includes a light source including a first light emitting element that emits visible light and a second light emitting element that emits infrared light, and a rotating reflector that rotates about a rotational axis while reflecting visible light and infrared light emitted from the light source. The rotating reflector emits, by its rotating operation, visible light from the first light emitting element as an irradiation beam such that, by scanning with the irradiation beam, a first light distribution pattern is produced in front of the vehicle. The rotating reflector also emits, by its rotating operation, infrared light from the second light emitting element as an irradiation beam such that, by scanning with the irradiation beam, a second light distribution pattern is produced in front of the vehicle. The light source is configured such that part of the second light distribution pattern overlaps with the first light distribution pattern and such that a region of the second light distribution pattern, which does not overlap with the first light distribution pattern, is provided on the side closer to a middle region in front of the vehicle with respect to the first light distribution pattern.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
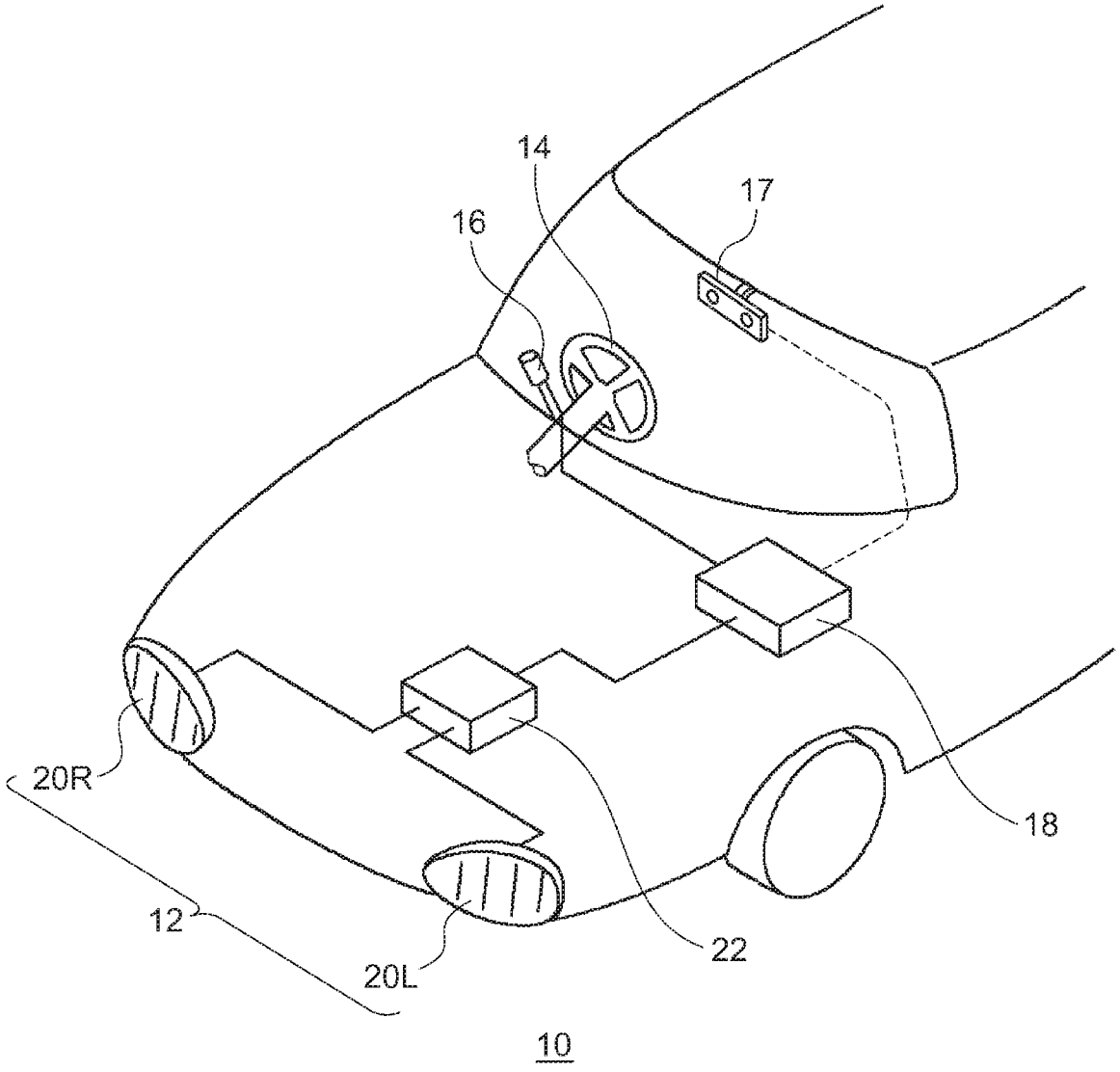
FIG. 1 is a schematic diagram that shows an external view of a front part of a vehicle to which a vehicular headlamp of the present embodiment is applied.

In the following, the present invention will be described based on an embodiment with reference to the drawings. Like reference characters denote like or corresponding constituting elements, members, and processes in each drawing, and repetitive description will be omitted as appropriate. The embodiment of the invention is provided for purposes of illustration and not limitation, and it should be understood that not all of the features or combinations thereof described in the embodiment are necessarily essential to the invention.

To solve the problem above, a lamp unit of one embodiment of the present invention is mounted on the right side or left side of a vehicle, and the lamp unit includes a light source including a first light emitting element that emits visible light and a second light emitting element that emits infrared light, and a rotating reflector that rotates about a rotational axis while reflecting visible light and infrared light emitted from the light source. The rotating reflector emits, by its rotating operation, visible light from the first light emitting element as an irradiation beam such that, by scanning with the irradiation beam, a first light distribution pattern is produced in front of the vehicle. The rotating reflector also emits, by its rotating operation, infrared light from the second light emitting element as an irradiation beam such that, by scanning with the irradiation beam, a second light distribution pattern is produced in front of the vehicle. The light source is configured such that part of the second light distribution pattern overlaps with the first light distribution pattern and such that a region of the second light distribution pattern, which does not overlap with the first light distribution pattern, is provided on the side closer to a middle region in front of the vehicle with respect to the first light distribution pattern.

According to this embodiment, in the lamp unit mounted on the right side of the vehicle, for example, a region of the second light distribution pattern, which does not overlap with the first light distribution pattern, i.e., the region only irradiated with infrared light by one lamp unit, can be provided on the side closer to a middle region in front of the vehicle with respect to the first light distribution pattern. Also, in the lamp unit mounted on the left side of the vehicle, for example, a region of the second light distribution pattern, which does not overlap with the first light distribution pattern, i.e., the region only irradiated with infrared light by one lamp unit, can also be provided on the side closer to the middle region in front of the vehicle with respect to the first light distribution pattern. Accordingly, such a region only irradiated with infrared light can be provided in a region relatively closer to the middle (a distant area) in front of the vehicle.

The second light emitting element may be disposed such that the second light distribution pattern includes a vanishing point in front of the vehicle. Accordingly, when the first light distribution pattern is produced, for which the first light emitting element is turned on and off to provide a distant region in front of the vehicle as a non-illuminated region, the non-illuminated region can be irradiated with infrared light, for example.

The first light emitting element may be disposed such that the first light distribution pattern includes a vanishing point in front of the vehicle.

The light source may further include a third light emitting element that emits visible light. The rotating reflector may emit, by its rotating operation, visible light from the third light emitting element as an irradiation beam such that, by scanning with the irradiation beam, a third light distribution pattern is produced in front of the vehicle. The light source may be configured such that the third light distribution pattern overlaps with the first light distribution pattern and the second light distribution pattern and such that a region of the second light distribution pattern, which does not overlap with the third light distribution pattern, is provided on the side closer to a middle region in front of the vehicle with respect to the third light distribution pattern. Accordingly, the luminous intensity of the region where the third light distribution pattern overlaps with the first light distribution pattern can be increased.

Another embodiment of the present invention relates to a vehicular headlamp. The vehicular headlamp includes a right lamp unit mounted on the right side of a vehicle and a left lamp unit mounted on the left side of the vehicle. The right lamp unit includes a first light source including a first light emitting element that emits visible light and a second light emitting element that emits infrared light, and a first rotating reflector that rotates about a rotational axis while reflecting visible light and infrared light emitted from the first light source. The first rotating reflector emits, by its rotating operation, visible light from the first light emitting element as an irradiation beam such that, by scanning with the irradiation beam, a first light distribution pattern is produced in front of the vehicle. The first rotating reflector also emits, by its rotating operation, infrared light from the second light emitting element as an irradiation beam such that, by scanning with the irradiation beam, a second light distribution pattern is produced in front of the vehicle. The first light source is configured such that part of the second light distribution pattern overlaps with the first light distribution pattern and such that a region of the second light distribution pattern, which does not overlap with the first light distribution pattern, is provided on the side closer to a middle region in front of the vehicle with respect to the first light distribution pattern. The left lamp unit includes a second light source including a third light emitting element that emits visible light and a fourth light emitting element that emits infrared light, and a second rotating reflector that rotates about a rotational axis while reflecting visible light and infrared light emitted from the second light source. The second rotating reflector emits, by its rotating operation, visible light from the third light emitting element as an irradiation beam such that, by scanning with the irradiation beam, a third light distribution pattern is produced in front of the vehicle. The second rotating reflector also emits, by its rotating operation, infrared light from the fourth light emitting element as an irradiation beam such that, by scanning with the irradiation beam, a fourth light distribution pattern is produced in front of the vehicle. The second light source is configured such that part of the fourth light distribution pattern overlaps with the third light distribution pattern and such that a region of the fourth light distribution pattern, which does not overlap with the third light distribution pattern, is provided on the side closer to a middle region in front of the vehicle with respect to the third light distribution pattern. The first light source and the second light source are configured such that a region of the second light distribution pattern, which does not overlap with the first light distribution pattern, overlaps with the third light distribution pattern and such that a region of the fourth light distribution pattern, which does not overlap with the third light distribution pattern, overlaps with the first light distribution pattern.

According to this embodiment, in the right lamp unit mounted on the right side of the vehicle, a region of the second light distribution pattern, which does not overlap with the first light distribution pattern, i.e., the region only irradiated with infrared light by the right lamp unit, can be provided on the side closer to a middle region in front of the vehicle with respect to the first light distribution pattern. Also, in the left lamp unit mounted on the left side of the vehicle, a region of the fourth light distribution pattern, which does not overlap with the third light distribution pattern, i.e., the region only irradiated with infrared light by the left lamp unit, can also be provided on the side closer to the middle region in front of the vehicle with respect to the third light distribution pattern. Further, by turning on the right lamp unit and the left lamp unit simultaneously, a region broader than that illuminated by one lamp unit can be irradiated with visible light, without causing a region only irradiated with infrared light.

Optional combinations of the aforementioned constituting elements, and implementation of the present invention in the form of methods, apparatuses, or systems may also be practiced as additional modes of the present invention. The present invention provides a new optical unit capable of producing various light distribution patterns using infrared light and visible light.

[Vehicle]

FIG. 1 is a schematic diagram that shows an external view of a front part of a vehicle to which a vehicular headlamp of the present embodiment is applied. A vehicle 10 in the present embodiment includes a vehicular headlamp 12, a switch 16 provided near a steering wheel 14 and used to switch the lamp mode, a camera 17 for capturing an image of an area in front of the vehicle, and a vehicle controller 18 that processes information captured by the camera 17, information detected by a sensor, not illustrated, provided in the vehicle, and information of switching operations for the switch 16 performed by the driver, for example. The camera 17 is provided with an imaging element that at least has sensitivity to light with a wavelength within a range from a wavelength of visible light to a wavelength of infrared light, and the camera 17 transmits information of a captured image to the vehicle controller 18.

The vehicular headlamp 12 includes a headlamp unit 20R mounted on the right side of a vehicle, and a headlamp unit 20L mounted on the left side of the vehicle. Based on the information transmitted from the vehicle controller 18, a headlamp controller 22 controls light irradiation, i.e., the shape and the position of a light distribution pattern provided by the headlamp unit 20R and the headlamp unit 20L.

Specifically, based on a signal transmitted from the vehicle controller 18, the headlamp controller 22 controls the headlamp units 20R and 20L based on the distance from a preceding vehicle travelling in front of the subject vehicle and the position of the preceding vehicle. In the present embodiment, when switching of the lamp mode using the switch 16 is performed, the headlamp controller 22 controls light irradiation by the headlamp units 20R and 20L appropriately for the selected lamp mode.

The lamp modes selectable by means of the switch 16 include a "traveling mode (high beam mode)", a "passing mode (low beam mode)", and an "automatic adjustment mode (a shading high beam mode)", for example. The automatic adjustment mode is a mode in which a light distribution pattern is adjusted based on the distance from a preceding vehicle and the position of the preceding vehicle. Also, the shading high beam mode is a mode for producing a shading high beam with which a partial region of a high beam light distribution pattern is not illuminated as appropriate, thereby reducing glare provided to a preceding vehicle present forward of the subject vehicle while improving visibility in a distant area.

[Vehicular Headlamp]

Figure 2:
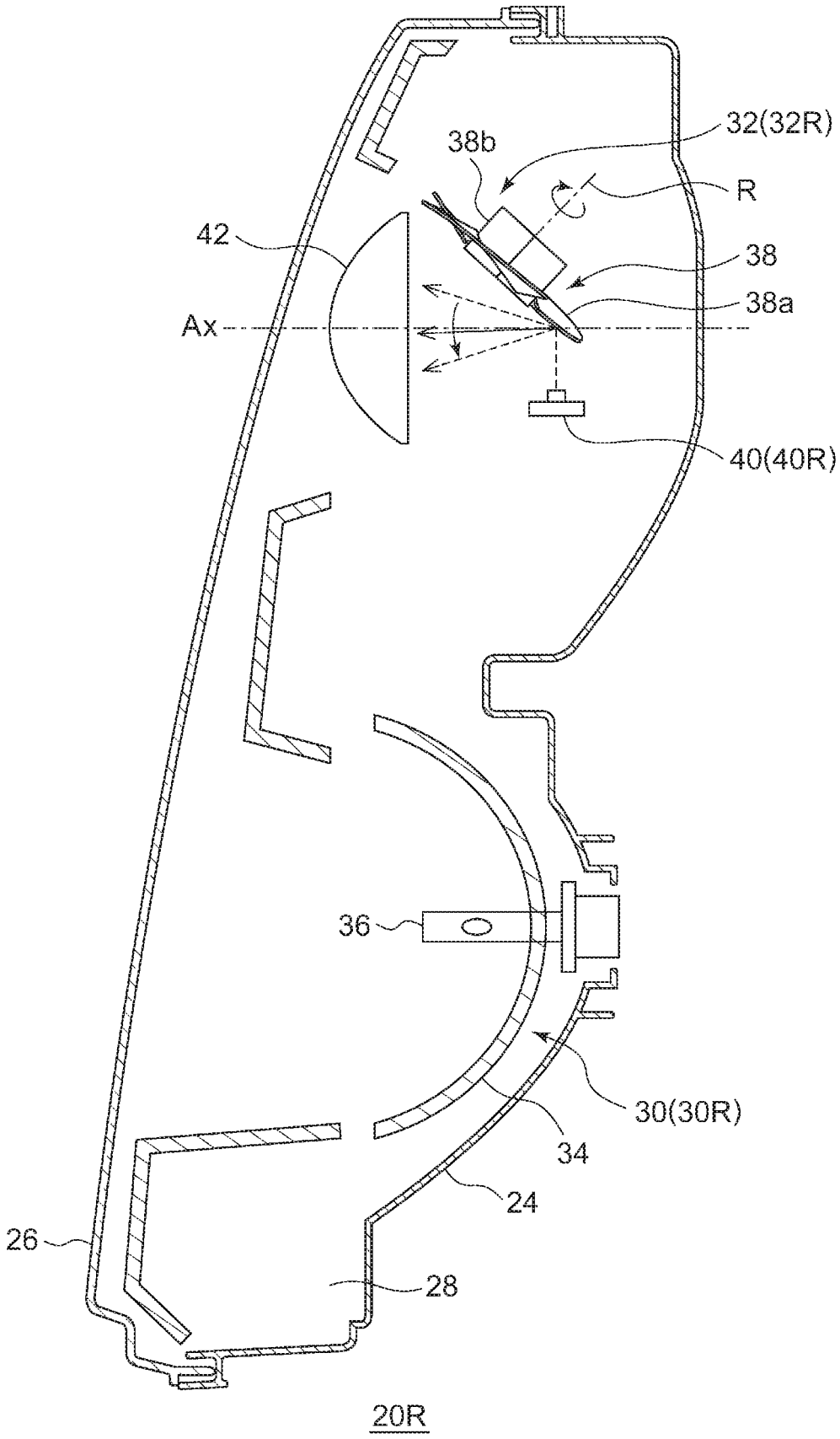
FIG. 2 is a horizontal sectional view of a headlamp unit provided on the right side in the present embodiment.

There will now be described a lamp unit shown in FIG. 1. FIG. 2 is a horizontal sectional view of the headlamp unit 20R provided on the right side in the present embodiment. The headlamp unit 20R shown in FIG. 2 is a right headlamp mounted on the right side of a front end part of an automobile and has almost the same structure as a headlamp mounted on the left side, except that the headlamps have symmetrical structures. Accordingly, in the following, the headlamp unit 20 on the right side will be described in detail, and the description for the headlamp unit on the left side may be omitted as appropriate.

As shown in FIG. 2, the headlamp unit 20R includes a lamp body 24 having a recess part that opens on the front side. The opening on the front side of the lamp body 24 is covered with a transparent front cover 26, thereby forming a lamp chamber 28. The lamp chamber 28 serves as a space in which two lamp units 30 and 32 arranged in a vehicle width direction are housed.

Of the lamp units, the lamp unit 32 disposed on the outer side of the vehicle, i.e., the upper side in the right headlamp unit 20R shown in FIG. 2, is a lamp unit provided with a lens and configured to emit a variable high beam. On the other hand, of the lamp units, the lamp unit 30 disposed on the inner side of the vehicle, i.e., the lower side in the right headlamp unit 20R shown in FIG. 2, is configured to emit a low beam.

The lamp unit 30 for low beams includes a reflector 34, a light source bulb (an incandescent bulb) 36 supported by the reflector 34, and a shade, which is not illustrated, and the reflector 34 is supported by a known means, such as a means using an aiming screw and a nut, which is not illustrated, such as to be tilted with respect to the lamp body 24.

As shown in FIG. 2, the lamp unit 32 includes a rotating reflector 38, a light source 40 provided with an LED or the like that emits visible light or infrared light, and a convex lens 42 as a projection lens disposed forward of the rotating reflector 38. Instead of the LED, a semiconductor light emitting element, such as an EL element and LD element, may be used for the light source 40. Particularly, in the control for shading, from light, part of a light distribution pattern, which will be described later, a light source of which turning on and off can be accurately performed in a short time is suitable. The shape of the convex lens 42 may be appropriately selected based on the required light distribution pattern and light distribution characteristics including illuminance distribution, and a non-spherical lens or a free-curved surface lens may be used.

The rotating reflector 38 rotates about a rotational axis R in one direction by means of a drive source, such as a motor, which is not illustrated. The rotating reflector 38 includes a reflecting surface configured to reflect light emitted from the light source 40 while rotating such as to produce a desired light distribution pattern.

In the rotating reflector 38, three blades 38*a*, having the same shape and functioning as reflecting surfaces, are provided around a rotating part 38*b* of cylindrical shape. The rotational axis R of the rotating reflector 38 is inclined with respect to an optical axis Ax and provided on a plane including the optical axis Ax and the light source 40. In other words, the rotational axis R is provided substantially in parallel with a scan plane of light (an irradiation beam) from the light source 40 used for scanning in left and right directions performed by the rotation of the rotating reflector 38. This can make the optical unit thinner.

The scan plane as used herein may be regarded as a fan-shaped plane formed by continuously connecting the trajectories of light from the light source 40 as scanning light, for example. Being substantially parallel need not necessarily mean being perfectly parallel, as long as it is virtually parallel, and errors within a range that will not significantly block the effects of the lamp units in an embodiment may be allowed.

In the lamp unit 32 of the present embodiment, an LED provided in the light source 40 is relatively small and shifted from the optical axis Ax.

Also, the blades 38*a* of the rotating reflector 38 are shaped such that a secondary light source (a virtual light source when there is no blade) of the light source 40 provided by reflection is formed near the focal point of the convex lens 42. Each of the blades 38*a* has a twisted shape such that the angle between the optical axis Ax and the reflecting surface changes according to the position in a circumferential direction when the rotational axis R is regarded as the center. This enables scanning with light from the light source 40, as shown in FIG. 2.

Figure 3:
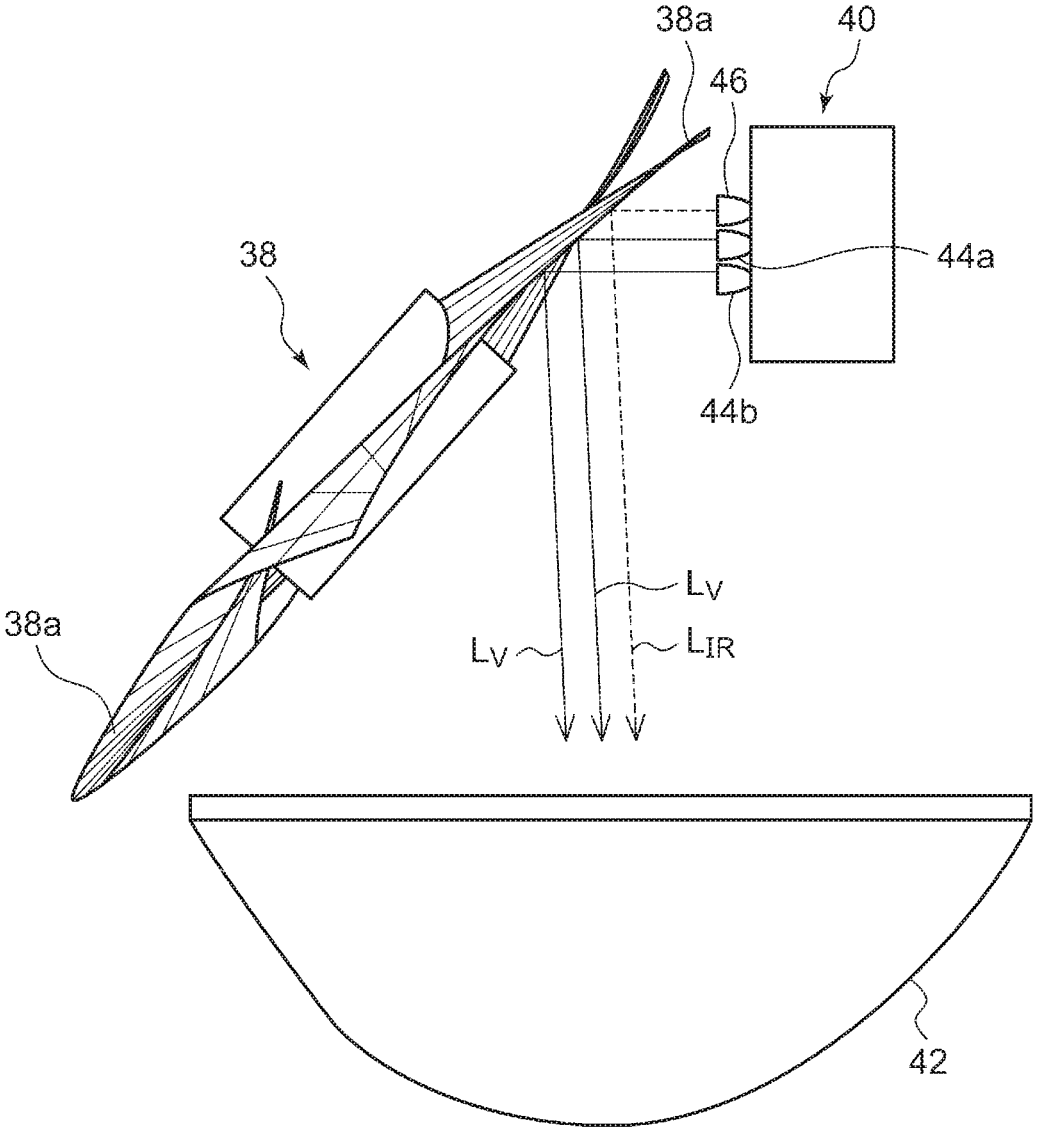
FIG. 3 is a top view that schematically shows a configuration of a lamp unit in the present embodiment.

FIG. 3 is a top view that schematically shows a configuration of the lamp unit 32 in the present embodiment.

The lamp unit 32 of the present embodiment includes the rotating reflector 38, light source 40, and convex lens 42. The light source 40 includes LED units 44*a* and 44*b* as first light emitting elements that emit visible light, and an infrared light unit 46 as a second light emitting element that emits infrared light. The rotating reflector 38 rotates about the rotational axis in one direction while reflecting visible light $L_V$ and infrared light $L_{IR}$ emitted from the light source 40.

The LED units 44*a* and 44*b* are LED units for light focusing and are arranged such as to enable strong light focusing on a front space in the travelling direction appropriate for a high beam light distribution pattern. Each light source need not necessarily be provided with multiple LED units, and may be provided with one LED unit if it can provide sufficient brightness. Also, all the LED units need not necessarily be always turned on, and only part of the LED units may be turned on depending on the traveling conditions of the vehicle or the situation in front of the vehicle.

By its rotating operation, the rotating reflector 38 emits the visible light $L_V$ from each of the LED units 44*a* and 44*b* as an irradiation beam such that, by scanning with the irradiation beam, a visible light distribution pattern is produced in front of the vehicle, and the rotating reflector 38 also emits the infrared light $L_{IR}$ from the infrared light unit 46 as an irradiation beam such that, by scanning with the irradiation beam, an infrared light distribution pattern is produced in front of the vehicle.

Accordingly, with the operation of the rotating reflector 38, the lamp unit 32 can produce a visible light distribution pattern by scanning with an irradiation beam of visible light and also can produce an infrared light distribution pattern by scanning with an irradiation beam of infrared light.

Figure 4:
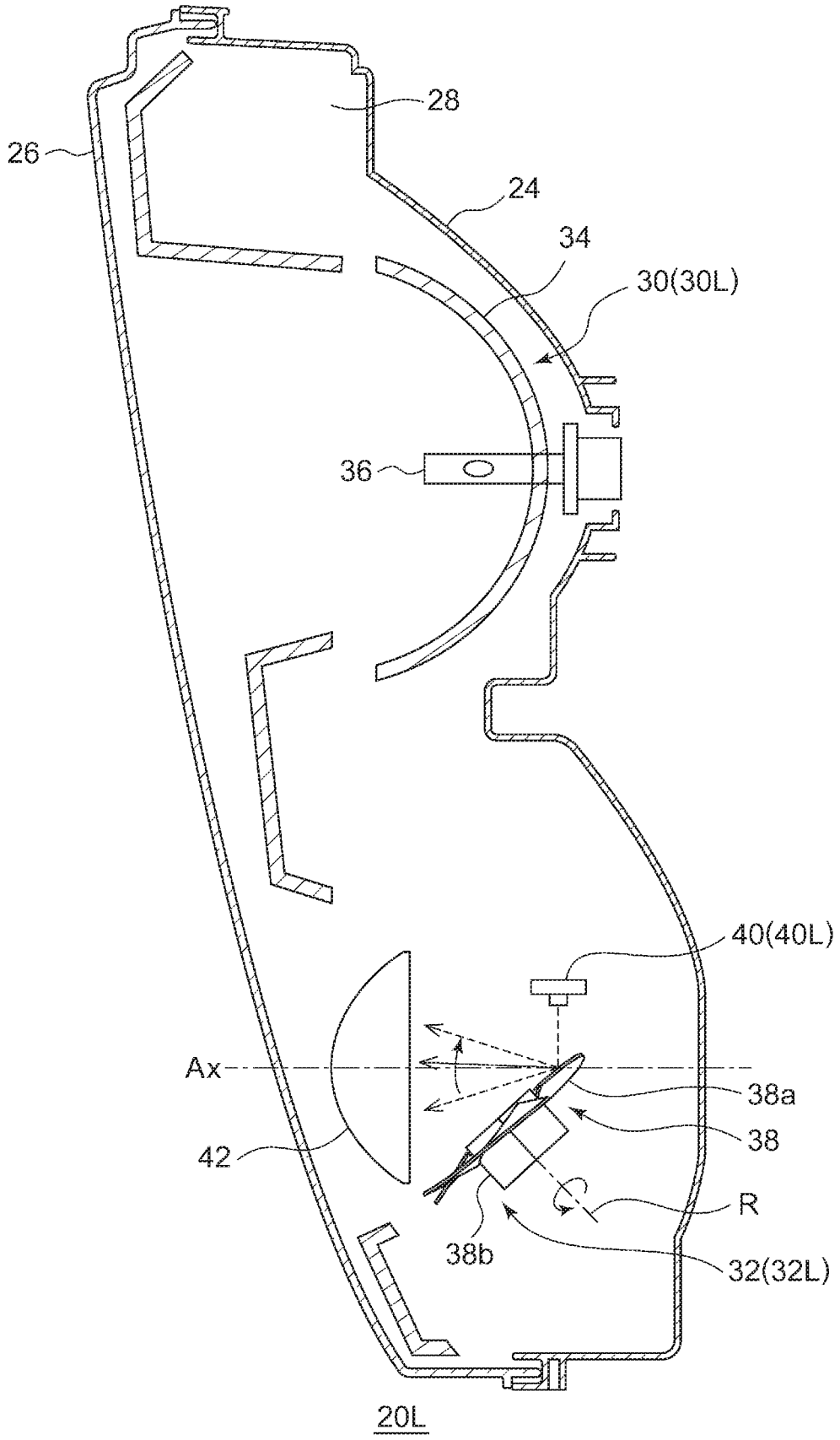
FIG. 4 is a horizontal sectional view of a headlamp unit provided on the left side in the present embodiment.

The lamp unit 32R provided in the headlamp unit 20R disposed on the right side of a front end part of the vehicle has been described; meanwhile, the lamp unit 32L provided in the headlamp unit 20L disposed on the left side of the front end part of the vehicle has almost the same configuration, except that the lamp unit 32L and the lamp unit 32R are symmetrical. FIG. 4 is a horizontal sectional view of the headlamp unit 20L provided on the left side in the present embodiment.

Figure 5A:
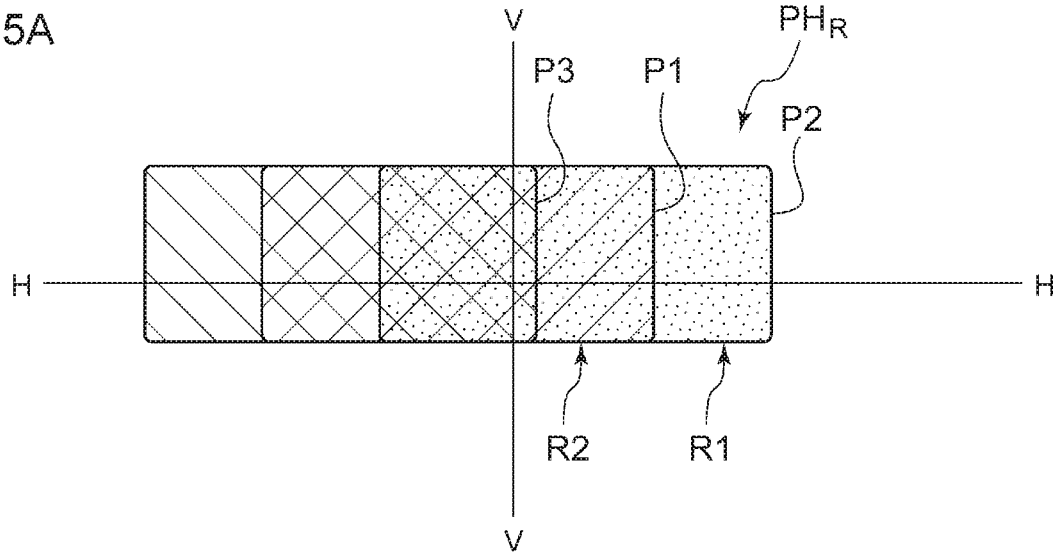
FIG. 5A is a diagram that schematically shows a partial high beam light distribution pattern $PH_R$ produced by the lamp unit provided in the headlamp unit mounted on the right side of a vehicle.
Figure 5B:
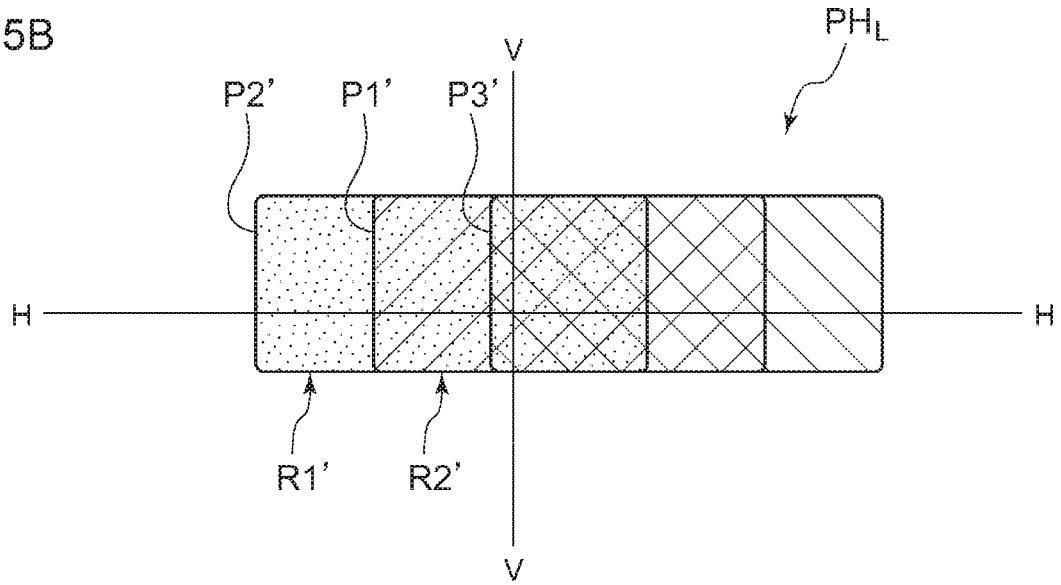
FIG. 5B is a diagram that schematically shows a partial high beam light distribution pattern $PH_L$ produced by the lamp unit provided in the headlamp unit mounted on the left side of the vehicle.

FIG. 5A is a diagram that schematically shows a partial high beam light distribution pattern $PH_R$ produced by the lamp unit 32R provided in the headlamp unit 20R mounted on the right side of the vehicle, and FIG. 5B is a diagram that schematically shows a partial high beam light distribution pattern $PH_L$ produced by the lamp unit 32L provided in the headlamp unit 20L mounted on the left side of the vehicle.

The partial high beam light distribution pattern $PH_R$ shown in FIG. 5A is produced by overlap of a visible light distribution pattern P1 produced in front of the vehicle by scanning with an irradiation beam of the visible light $L_V$ from the LED unit 44*a* of the light source 40R, an infrared light distribution pattern P2 produced in front of the vehicle by scanning with an irradiation beam of the infrared light $L_{IR}$ from the infrared light unit 46, and a visible light distribution pattern P3 produced in front of the vehicle by scanning with an irradiation beam of the visible light $L_V$ from the LED unit 44*b*.

More specifically, the light source 40R of the lamp unit 32R mounted on the right side of the vehicle is configured such that part of the infrared light distribution pattern P2 overlaps with the visible light distribution pattern P1 and such that a region R1 of the infrared light distribution pattern P2, which does not overlap with the visible light distribution pattern P1, is provided on the side closer to a middle region in front of the vehicle with respect to the visible light distribution pattern P1 (to the right of the visible light distribution pattern P1). In other words, the region R1 of the infrared light distribution pattern P2, which does not overlap with the visible light distribution pattern P1, is not provided on the side farther from the middle region in front of the vehicle with respect to the visible light distribution pattern P1 (to the left of the visible light distribution pattern P1). The middle region used herein may be a region that includes the point of intersection between the line H-H and the line V-V, for example.

The light source 40R is also configured such that the visible light distribution pattern P3 overlaps with the visible light distribution pattern P1 and the infrared light distribution pattern P2. Accordingly, the luminous intensity of the region where the visible light distribution pattern P3 overlaps with the visible light distribution pattern P1 can be increased. Also, the light source 40R is configured such that a region R2 of the infrared light distribution pattern P2, which does not overlap with the visible light distribution pattern P3, is provided on the side closer to the middle region in front of the vehicle with respect to the visible light distribution pattern P3.

Similarly to the partial high beam light distribution pattern $PH_R$ shown in FIG. 5A, the partial high beam light distribution pattern $PH_L$ shown in FIG. 5B is produced by means of the light source 40L of the lamp unit 32L mounted on the left side of the vehicle. Specifically, the partial high beam light distribution pattern $PH_L$ is produced by overlap of a visible light distribution pattern P1' produced in front of the vehicle by scanning with an irradiation beam of the visible light $L_V$ from the LED unit 44*a* of the light source 40L, an infrared light distribution pattern P2' produced in front of the vehicle by scanning with an irradiation beam of the infrared light $L_{IR}$ from the infrared light unit 46, and a visible light distribution pattern P3' produced in front of the vehicle by scanning with an irradiation beam of the visible light $L_V$ from the LED unit 44*b*.

More specifically, the light source 40L of the lamp unit 32L mounted on the left side of the vehicle is configured such that part of the infrared light distribution pattern P2' overlaps with the visible light distribution pattern P1' and such that a region R1' of the infrared light distribution pattern P2', which does not overlap with the visible light distribution pattern P1', is provided on the side closer to the middle region in front of the vehicle with respect to the visible light distribution pattern P1' (to the left of the visible light distribution pattern P1'). In other words, the region R1' of the infrared light distribution pattern P2', which does not overlap with the visible light distribution pattern P1', is not provided on the side farther from the middle region in front of the vehicle with respect to the visible light distribution pattern P1' (to the right of the visible light distribution pattern P1').

The light source 40L is also configured such that the visible light distribution pattern P3' overlaps with the visible light distribution pattern P1' and the infrared light distribution pattern P2'. Accordingly, the luminous intensity of the region where the visible light distribution pattern P3' overlaps with the visible light distribution pattern P1' can be increased. Also, the light source 40L is configured such that a region R2' of the infrared light distribution pattern P2', which does not overlap with the visible light distribution pattern P3', is provided on the side closer to the middle region in front of the vehicle with respect to the visible light distribution pattern P3'.

Thus, in the lamp unit 32R mounted on the right side of the vehicle, the region R1' of the infrared light distribution pattern P2, which does not overlap with the visible light distribution pattern P1, i.e., the region only irradiated with infrared light by one lamp unit, can be provided on the side closer to the middle region in front of the vehicle with respect to the visible light distribution pattern P1. Also, in the lamp unit 32L mounted on the left side of the vehicle, the region R1' of the infrared light distribution pattern P2', which does not overlap with the visible light distribution pattern P1', i.e., the region only irradiated with infrared light by one lamp unit, can be provided on the side closer to the middle region in front of the vehicle with respect to the visible light distribution pattern P1'. Accordingly, such a region only irradiated with infrared light can be provided in a region relatively closer to the middle (a distant area) in front of the vehicle.

There will now be described light distribution patterns that can be provided by the vehicular headlamp 12 of the present embodiment.

Figure 6:
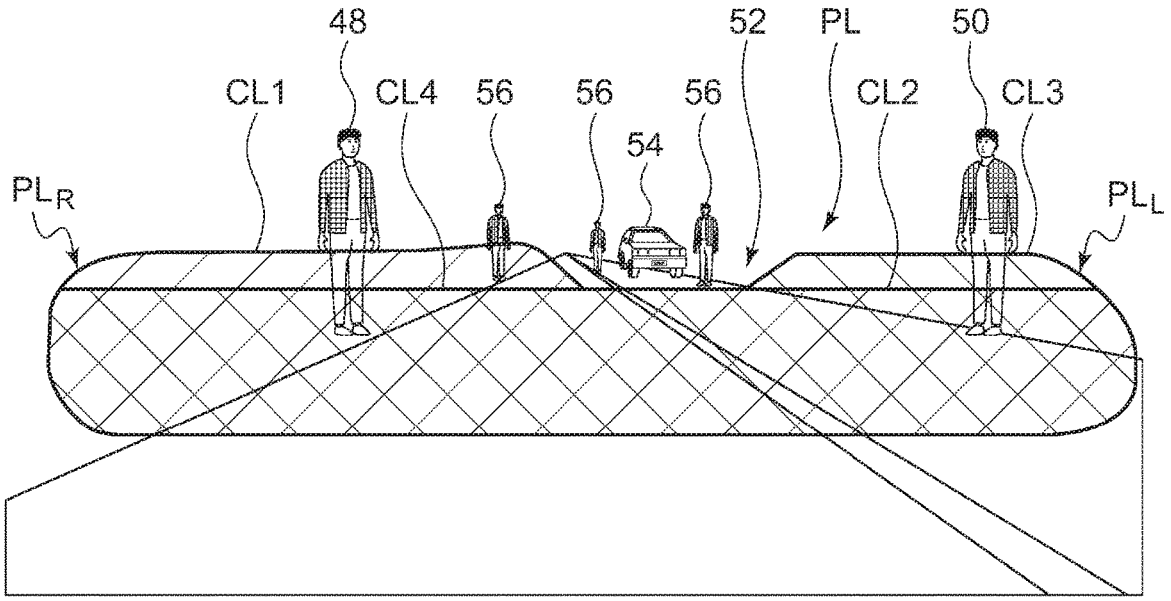
FIG. 6 is a diagram that schematically shows a low beam light distribution pattern PL in the present embodiment.

FIG. 6 is a diagram that schematically shows a low beam light distribution pattern PL in the present embodiment. The low beam light distribution pattern PL shown in FIG. 6 is produced by overlap of a partial low beam light distribution pattern $PL_R$ produced by the lamp unit 30R of the headlamp unit 20R, and a partial low beam light distribution pattern $PL_L$ produced by the lamp unit 30L of the headlamp unit 20L.

In the partial low beam light distribution pattern $PL_R$, a cutoff line CL1 in a region located to the left of the opposite traffic lane on the traveling lane side is provided higher than a cutoff line CL2 in a region on the opposite traffic lane side from the traveling lane. Accordingly, even with the low beam light distribution pattern PL, an area around the feet of a pedestrian 48, who walks closer to the subject vehicle among pedestrians walking on the sidewalk on the traveling lane side, can be illuminated, so that the visibility of the pedestrian 48 is high. Also, in the partial low beam light distribution pattern $PL_L$, a cutoff line CL3 in a region located to the right of the opposite traffic lane is provided higher than a cutoff line CL4 in a region located to the left of the opposite traffic lane. Accordingly, even with the low beam light distribution pattern PL, an area around the feet of a pedestrian 50, who walks closer to the subject vehicle among pedestrians walking on the sidewalk on the opposite traffic lane side, can be illuminated, so that the visibility of the pedestrian 50 is high.

In addition, in the middle part of the low beam light distribution pattern PL, a recess part 52 is formed, so that glare provided to an oncoming vehicle 54 traveling in a distant area on the opposite traffic lane can be reduced. Meanwhile, since a pedestrian 56 present in the recess part 52, which is in a distant region, appears small in size, high luminous intensity is required for visual recognition thereof. Accordingly, when a high beam light distribution pattern is produced while the oncoming vehicle 54 is not present, a region including the recess part 52 particularly needs to be illuminated more brightly.

Figure 7:
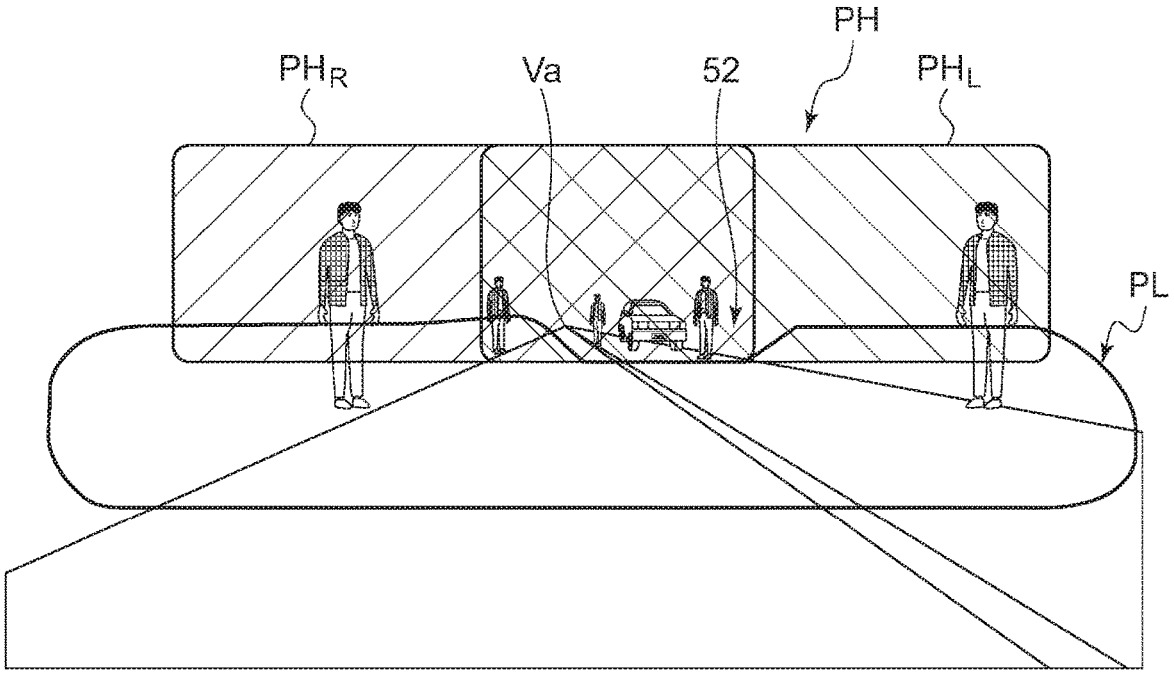
FIG. 7 is a diagram that shows a state where the low beam light distribution pattern PL and a high beam light distribution pattern PH are produced in front of the vehicle by means of the vehicular headlamp of the present embodiment.

FIG. 7 is a diagram that shows a state where the low beam light distribution pattern PL and a high beam light distribution pattern PH are produced in front of the vehicle by means of the vehicular headlamp 12 of the present embodiment. In FIG. 7, the infrared light distribution pattern P2 (P2') need not necessarily be produced.

The high beam light distribution pattern PH is produced by overlap of the partial high beam light distribution pattern $PH_R$ shown in FIG. 5A and the partial high beam light distribution pattern $PH_L$ shown in FIG. 5B, and the high beam light distribution pattern PH illuminates a distant region including the recess part 52 and a vanishing point Va in front of the vehicle. In the present embodiment, the visible light distribution pattern P1 produced by the lamp unit 32R and the visible light distribution pattern P1' produced by the lamp unit 32L are provided such as to include a region near the vanishing point Va in front of the vehicle. This improves visibility of a pedestrian 56 present in the distant region. Especially, in the present embodiment, the visible light distribution pattern P3 produced by the lamp unit 32R and the visible light distribution pattern P3' produced by the lamp unit 32L are also provided such as to include a region near the vanishing point Va in front of the vehicle (see FIGS. 5A and 5B). This further improves visibility of a pedestrian 56 present in the distant region.

There will now be described a shading high beam light distribution pattern with which a partial region of a high beam light distribution pattern is not illuminated as appropriate, depending on the situation in front of the vehicle, thereby reducing glare provided to a preceding vehicle present forward of the subject vehicle while improving visibility in a distant area.

Figure 8:
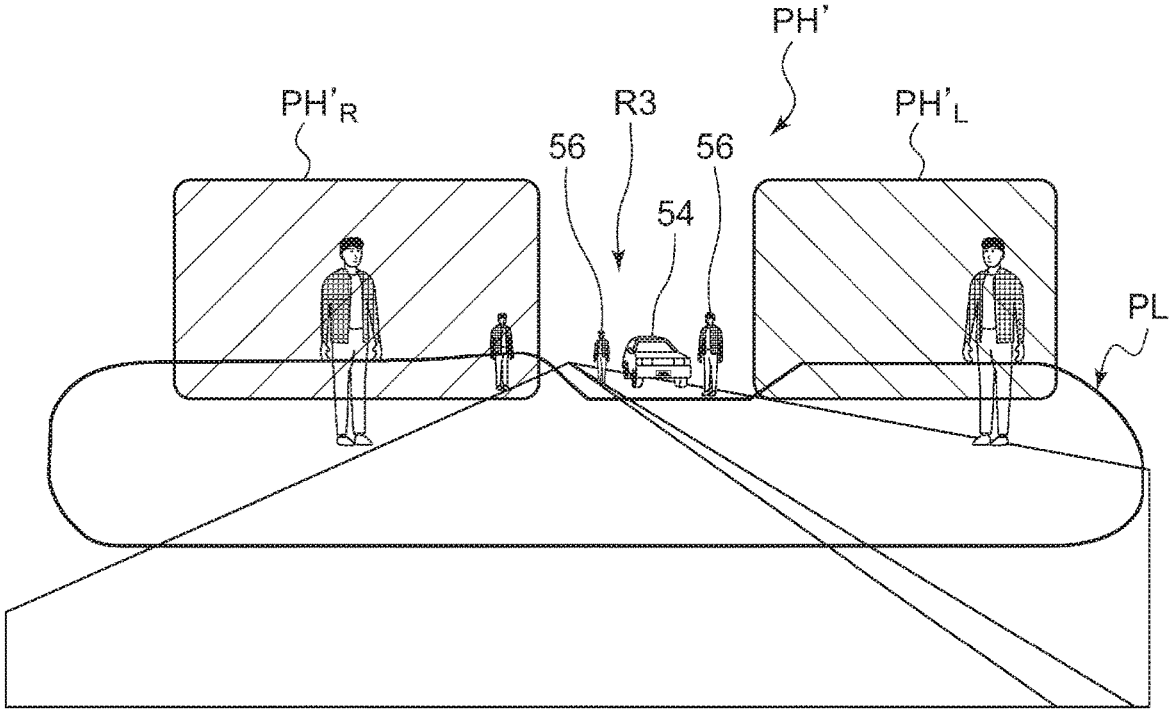
FIG. 8 is a diagram that shows a state where a shading high beam light distribution pattern PH' is produced.

FIG. 8 is a diagram that shows a state where a shading high beam light distribution pattern PH' is produced. As shown in FIG. 8, the shading high beam light distribution pattern PH' is produced by synthesizing a partial high beam light distribution pattern $PH'_R$ produced by the lamp unit 30R and a partial high beam light distribution pattern $PH'_L$ produced by the lamp unit 30L, and a distant region R3 including the vanishing point in the middle of the vehicle is not illuminated. Accordingly, glare provided to the oncoming vehicle 54 can be reduced, but the visibility of the pedestrians 56 present in the distant region R3 is insufficient.

Figure 9:
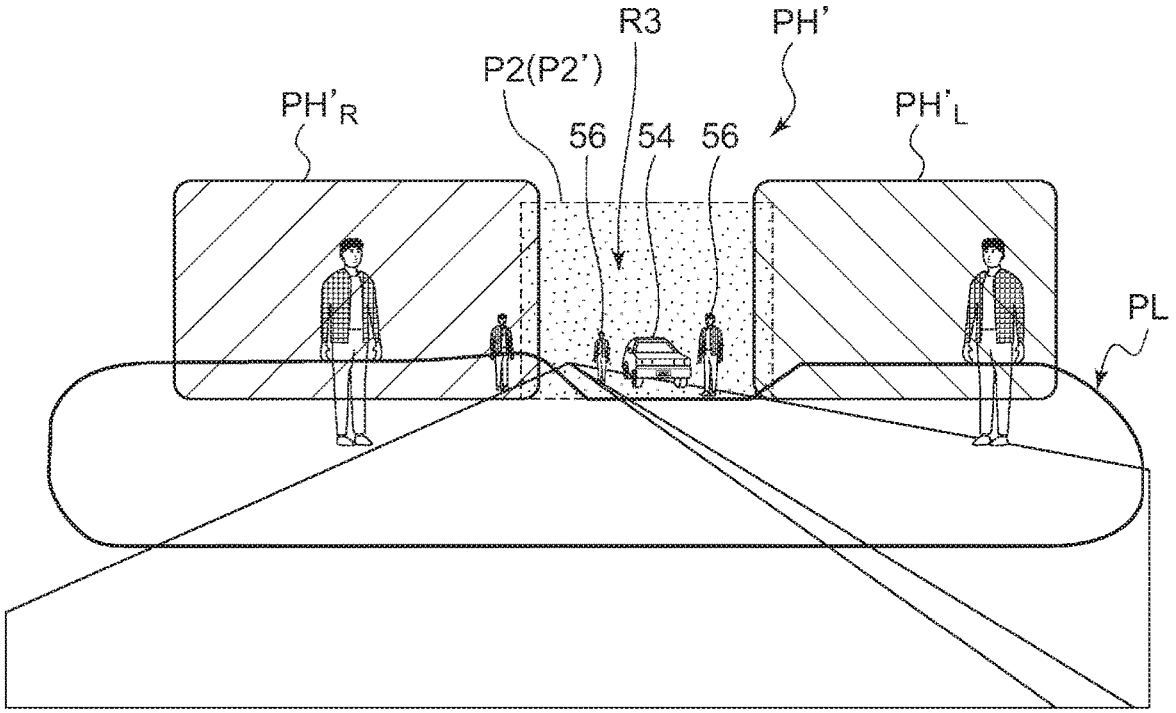
FIG. 9 is a diagram that shows a state where the shading high beam light distribution pattern PH' overlapping with an infrared light distribution pattern is produced.

FIG. 9 is a diagram that shows a state where the shading high beam light distribution pattern PH' overlapping with an infrared light distribution pattern is produced. As shown in FIG. 9, the distant region R3 is irradiated with infrared light distribution patterns P2 and P2'. Accordingly, with regard to the pedestrians 56 who cannot be easily recognized by the driver, by capturing an image of an area in front of the vehicle using the camera 17 having sensitivity to infrared light, the presence of the pedestrians 56 can be recognized. Therefore, information for warning can be provided to various devices within the vehicle 10, such as a monitor and a head-up display.

In the present embodiment, the infrared light unit 46 is disposed such that the infrared light distribution pattern P2 (P2') includes the vanishing point Va in front of the vehicle. Accordingly, when the visible light distribution pattern P1 is produced, for which the LED unit 44*a* is turned on and off to provide the distant region R3 in front of the vehicle as a non-illuminated region, the non-illuminated region can be irradiated with infrared light, as shown in FIG. 9.

In the lamp unit 32R mounted on the right side in the present embodiment, the region R1 of the infrared light distribution pattern P2, which does not overlap with the visible light distribution pattern P1, i.e., the region only irradiated with infrared light by the lamp unit 32R, can be provided on the side closer to the middle region in front of the vehicle with respect to the visible light distribution pattern P1, as shown in FIG. 5A. Also, in the lamp unit 32L mounted on the left side of the vehicle, the region R1' of the infrared light distribution pattern P2', which does not overlap with the visible light distribution pattern P1', i.e., the region only irradiated with infrared light by the lamp unit 32L, can be provided on the side closer to the middle region in front of the vehicle with respect to the visible light distribution pattern P1'.

Further, as shown in FIG. 7, by turning on the lamp unit 32R and the lamp unit 32L simultaneously, a region broader than that illuminated by one lamp unit can be irradiated with visible light, without causing a region only irradiated with infrared light.

The present invention has been described with reference to the aforementioned embodiment. However, the present invention is not limited thereto and also includes a form resulting from appropriate combination or replacement of the configurations in the embodiment. It is also to be understood that appropriate changes of the combination or the order of processes in the embodiment or various modifications, including design modifications, may be made based on the knowledge of those skilled in the art and that such changes and modifications also fall within the scope of the present invention.

The invention claimed is:

1. A lamp unit mounted on the right side or left side of a vehicle, the lamp unit comprising:

a light source comprising a first light emitting element that emits visible light and a second light emitting element that emits infrared light; and a rotating reflector that rotates about a rotational axis while reflecting the visible light and the infrared light emitted from the light source, wherein:

the rotating reflector emits, by its rotating operation, visible light from the first light emitting element as an irradiation beam such that, by scanning with the irradiation beam, a first light distribution pattern is produced in front of the vehicle;

the rotating reflector also emits, by its rotating operation, infrared light from the second light emitting element as an irradiation beam such that, by scanning with the irradiation beam, a second light distribution pattern is produced in front of the vehicle; and the light source is configured such that part of the second light distribution pattern overlaps with the first light distribution pattern and such that a region of the second light distribution pattern, which does not overlap with the first light distribution pattern, is provided on the side closer to a middle region in front of the vehicle with respect to the first light distribution pattern.

2. The lamp unit of claim 1, wherein the second light emitting element is disposed such that the second light distribution pattern includes a vanishing point in front of the vehicle.

3. The lamp unit of claim 1, wherein the first light emitting element is disposed such that the first light distribution pattern includes a vanishing point in front of the vehicle.

4. The lamp unit of claim 1, wherein:

the light source further comprises a third light emitting element that emits visible light;

the rotating reflector emits, by its rotating operation, visible light from the third light emitting element as an irradiation beam such that, by scanning with the irradiation beam, a third light distribution pattern is produced in front of the vehicle; and the light source is configured such that the third light distribution pattern overlaps with the first light distribution pattern and the second light distribution pattern and such that a region of the second light distribution pattern, which does not overlap with the third light distribution pattern, is provided on the side where the lamp unit is mounted, with respect to the third light distribution pattern.

5. A vehicular headlamp comprising a right lamp unit mounted on the right side of a vehicle and a left lamp unit mounted on the left side of the vehicle, the right lamp unit comprising:

a first light source comprising a first light emitting element that emits visible light and a second light emitting element that emits infrared light; and a first rotating reflector that rotates about a rotational axis while reflecting the visible light and the infrared light emitted from the first light source, wherein:

the first rotating reflector emits, by its rotating operation, visible light from the first light emitting element as an irradiation beam such that, by scanning with the irradiation beam, a first light distribution pattern is produced in front of the vehicle;

the first rotating reflector also emits, by its rotating operation, infrared light from the second light emitting element as an irradiation beam such that, by scanning with the irradiation beam, a second light distribution pattern is produced in front of the vehicle; and the first light source is configured such that part of the second light distribution pattern overlaps with the first light distribution pattern and such that a region of the second light distribution pattern, which does not overlap with the first light distribution pattern, is provided on the side closer to a middle region in front of the vehicle with respect to the first light distribution pattern, the left lamp unit comprising:

a second light source comprising a third light emitting element that emits visible light and a fourth light emitting element that emits infrared light; and a second rotating reflector that rotates about a rotational axis while reflecting the visible light and the infrared light emitted from the second light source, wherein:

the second rotating reflector emits, by its rotating operation, visible light from the third light emitting element as an irradiation beam such that, by scanning with the irradiation beam, a third light distribution pattern is produced in front of the vehicle;

the second rotating reflector also emits, by its rotating operation, infrared light from the fourth light emitting element as an irradiation beam such that, by scanning with the irradiation beam, a fourth light distribution pattern is produced in front of the vehicle; and the second light source is configured such that part of the fourth light distribution pattern overlaps with the third light distribution pattern and such that a region of the fourth light distribution pattern, which does not overlap with the third light distribution pattern, is provided on the side closer to a middle region in front of the vehicle with respect to the third light distribution pattern, the first light source and the second light source being configured such that:

a region of the second light distribution pattern, which does not overlap with the first light distribution pattern, overlaps with the third light distribution pattern; and a region of the fourth light distribution pattern, which does not overlap with the third light distribution pattern, overlaps with the first light distribution pattern.

* * * * *